United States Patent [19]

Goosman

[11] 4,194,558

[45] Mar. 25, 1980

[54] WASTE HEAT RECOVERY DEVICE

[76] Inventor: Richard Goosman, 44 Albermarle Rd., Hamilton Square, N.J. 08690

[21] Appl. No.: 904,948

[22] Filed: May 11, 1978

[51] Int. Cl.[2] ..... F28D 15/00

[52] U.S. Cl. ..... 165/105; 122/20 B; 165/DIG. 12; 126/117; 237/50

[58] Field of Search ..... 165/105, DIG. 12; 126/117; 237/50; 122/20 B, DIG. 2

[56] References Cited

U.S. PATENT DOCUMENTS

| | | | |
|---|---|---|---|
| 1,873,876 | 8/1932 | Downs | 165/105 X |
| 2,225,181 | 12/1940 | Powers | 126/117 X |
| 2,237,054 | 4/1941 | Jensen | 165/105 X |
| 2,966,033 | 12/1960 | Hughel | 165/105 X |
| 4,091,547 | 5/1978 | Leigh | 165/105 X |

FOREIGN PATENT DOCUMENTS

| | | | |
|---|---|---|---|
| 899328 | 6/1962 | United Kingdom | 165/105 |

*Primary Examiner*—Albert W. Davis, Jr.

*Attorney, Agent, or Firm*—John J. Kane; Frederick A. Zoda; Albert Sperry

[57] ABSTRACT

A waste heat recovery device particularly usable for heating the air traveling through a cold air return duct to a hot air gas heating furnace which includes an exhaust box securable to the wall of the furnace and adapted to receive exhaust gases therein to gather heat in the plenum chamber defined by the exhaust box, the exhaust box also including an exhaust gas outlet to expel gases to the existing heater stack or flue for venting, the plenum chamber including an exhaust coil being in fluid flow communication through a conduit to a return coil which is located within the cold air return, the conduit means being partially filled with a thermal transfer fluid such as water which will boil within the conduit in the exhaust coil means and will condense within the conduit in the return coil means and as such will effect rapid thermal transfer from the heated exhaust waste to the incoming cold air traveling through the cold air return and thereby achieve waste heat recovery.

9 Claims, 3 Drawing Figures

WASTE HEAT RECOVERY DEVICE

BACKGROUND OF THE INVENTION

1. Field of the Invention

The present invention provides an economizer by utilizing air-to-air heat exchange between the hot gases flowing up the exhaust flue of a hot air gas furnace and the cold air return which supplies air for heating. With the high cost of energy the additional savings created by making use of the heat in otherwise exhausted hot gases is quite beneficial in increasing the operating efficiency of hot air gas furnaces.

In an effort to increase the efficiency of such hot air gas furnaces many devices have been conceived to make efficient usage of this normally exhausted hot air. No device within this field has yet been designed which makes usage of conventional and readily available low cost parts to be used in the fabrication of a device for increasing the efficiency of a gas furnace. The present invention provides such a device.

2. Description of the Prior Art

A large number of patents have dealt with the problem of making efficient usage of the heated gases normally expelled out of the flue up the chimney with a gas hot air furnace. Examples of such U.S. Pat. Nos. are listed as follows: 459,395; 649,251; 1,953,302; 2,035,341; 2,143,287; 2,348,569; 2,573,364; 2,874,943; 2,893,705; 3,198,190; 3,916,991; and 3,993,244. The U.S. Pat. No. 3,198,190 discloses a system which recirculates vented gases in a furnace whereby the hot gases are recombusted to reduce carbon monoxide therein. As such that design deals with pollution rather than energy savings and as such is not applicable to the present invention.

The U.S. Pat. No. 3,993,244 discloses a system for increasing the flow of heat by decreasing the loss of heat through the venting ducts which is achieved by utilizing flow through an auxiliary non-gaseous heat conducting member. As such this sytem does not provide a means for increasing the temperature of the incoming air traveling through the cold air return.

U.S. Pat. No. 3,916,991 discloses a three conduit system including an inner conduit comprising the main vent of the furnace to the chimney with another conduit configured therearound to extract heat thereform and a third conduit encompassing both the first and second conduits to gather the heated gas passing by the second conduit to carry the heat to the chimney. This system is designed to increase heating at any remote location and does not use the boiling and condensing thermal transfer affect as disclosed in the claims of the present invention.

No system of the prior art has yet been described which utilizes conventional low cost parts and the ease of installation which is inherent with the design of the present concept. This invention provides a means for directly communicating heat normally lost through the exhaust flue to be utilized efficiently in the heating of the air traveling through the cold air return and as such is a novel concept.

SUMMARY OF THE INVENTION

The present invention provides a waste heat recovery device which functions as an air to air heat exchanger to recover as much as 5,000 BTU/Hr from the conventionally exhausted flue gas of a hot air gas furnace. This recovery is achieved by the formation of an exhaust box which defines a plenum chamber therein for gathering the heated exhaust gases. The exhaust box includes an exhaust gas inlet therein and an exhaust gas outlet therein to allow for the entry and exit of the exhausting warm gases.

Within the exhaust box is placed an exhaust coil means which operates within the plenum chamber to withdraw heat from the exhausting gases. The exhaust coil means includes a conduit means therein which contains a predetermined level of thermal transfer fluid such as water and the like. The conduit means provides a fluid flow communication path for the thermal transfer fluid between the exhaust coil means and a return coil means which is positioned within the cold air return of a conventional heating device to be adapted to radiate heat to raise the temperature of the air traveling through this cold air return and being supplied for heating to the heating device. Preferably this heating device should be a gaseous heating device in order to minimize corrosion and other detrimental effects to the exhaust coil means.

The conduit can be defined to include a condensing area within the cold air return duct and a boiler area within the exhaust coil means. The condensing area should be located at a slightly higher elevation than the boiler area to assure the return of condensed thermal transfer fluid after cooling thereof from the condenser area to the boiler area to thereby facilitate further boiling.

In operation the hot exhausting gases in the plenum chamber will provide heat to the exhaust coil means and communicate it to the boiler area of the conduit means. The thermal transfer fluid will be filled to an intermediate level within the boiler area and as such the absorption of heat will cause the boiling of the water or other fluid within the boiler area. This hot gaseous vapor will flow upward into the slightly elevated return coil means where it will be condensed. During condensing in the condenser area the heat and the warm gaseous vapor will be withdrawn from the fluid and radiated by the return coil means to thereby heat the air traveling through the cold air return duct and increase the operating efficiency of the heater device associated with the present invention. The condensed fluid will then flow downward by gravitational flow due to the slight elevation of the condenser area and return to the boiler area for further boiling to thereby complete the cycle of the system.

In some embodiments it may be desirable to orient the individual coil elements of the exhaust coilings in vertical rather than horizontal orientation and under such configurations it is necessary to maintain a minimum level of the thermal transfer fluid within each individual coil. In order to achieve this purpose a fluid level control means such as a drain conduit may be utilized extending upwardly from the area of one coil to the area of another coil to place the upper edge thereof at the predetermined desired level of the thermal transfer fluid in the higher coil element to in combination both maintain a minimum level of the thermal transfer fluid within the higher coil and to provide a path for flow of the thermal fluid to the lower coil and further coil elements at lower levels.

The present invention may also include an exhaust valve which can be used to control the amount of thermal fluid and the pressure within the conduit means.

It is an object of the present invention to provide an air to air heat exchanger designed to recover 5,000 BTU/Hr from the flue gas of a hot air gas furnace.

It is an object of the present invention to provide a waste heat recovery device which reduces the temperature of exhausted flue gas in conventional hot air gas furnaces by more than 100° F. to decrease the upper draft velocity and thus decrease the quantity of gases going up the flue in total.

It is an object of the present invention to provide a waste heat recovery device which is usable in conjunction with a night set back thermostat.

It is an object of the present invention to provide a waste heat recovery device which is usable with a power operated flue of a hot gas furnace.

It is an object of the present invention to provide a waste heat recovery device which may be constructed of low cost easily available parts.

It is an object of the present invention to provide a waste heat recovery device which should take no more than eight hours for installation and requires no special skills for such installation.

It is an object of the present invention to provide a means for recovery waste heat from the exhaust flue of a hot air gas furnace or other heat generating devices by heating the air returning to the heating device through the cold air return duct.

It is an object of the present invention to provide a waste heat recovery device which can utilize a variety of thermal transfer fluids and is most particularly usable with the most conveniently available such fluid, water.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 2:
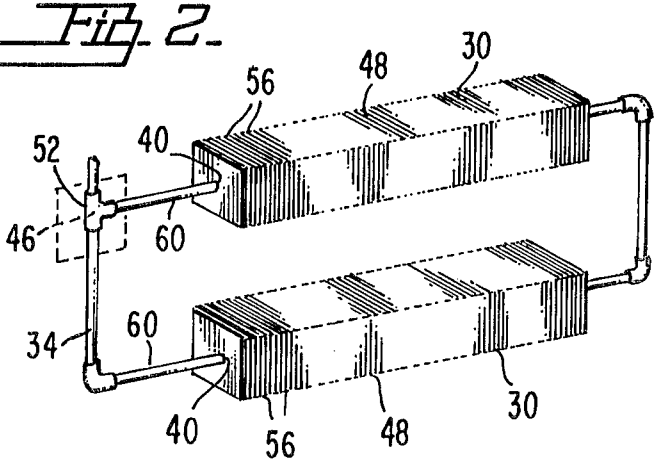
FIG. 2 is a perspective view of an embodiment of the present invention showing individual exhaust coil means mounted vertically.

In a preferred embodiment of the present invention an exhaust box 22 is utilized by attachment to a conventional heating device 10. Normally conventional hot air heaters include an exhaust flue 12 for venting which expels heated gases. The heating device 10 includes a heater core 16 which is warmed by a gas burner 18 to supply heated air through the hot air supply duct 20. To supply air to the heating device 10 itself a cold air return 14 is provided.

The exhaust box 22 of the present invention defines the plenum chamber 24 therein. The exhaust box preferably is secured to the heating device 10 such that the gases being transferred to the exhaust flue 12 will first pass through plenum chamber 24. In order to incorporate this exhaust gas flow the exhaust box 22 includes an exhaust gas inlet 26 which may receive the flue gases directly from the heating device 10. These warmed gases will then flow through the plenum chamber 24 to an exhaust gas outlet 28 which will expel the gases and the remaining heat therein to the conventional flue exhaust or heater stack.

An exhuast coil means 30 is positioned within the plenum chamber 24 to withdraw heat from the exhausting gas. This heat is then communicated to a return coil means 32 by a conduit means 34 which carries thermal transfer fluid 36 therebetween.

The exhaust coil means 30 will cause the heating of the thermal transfer fluid which is located therein and this warmed fluid will conduct this heat through the conduit means 34 to the return coil means 32 which is positioned within the cold air return 14 to heat the returning air. The portion of the conduit means 34 located within the exhaust coil means 30 can be defined as the boiler area 40 thereof. Similarly, the portion of the conduit means 34 within the return coil means 32 can be defined as the condensing area 38.

Figure 1:
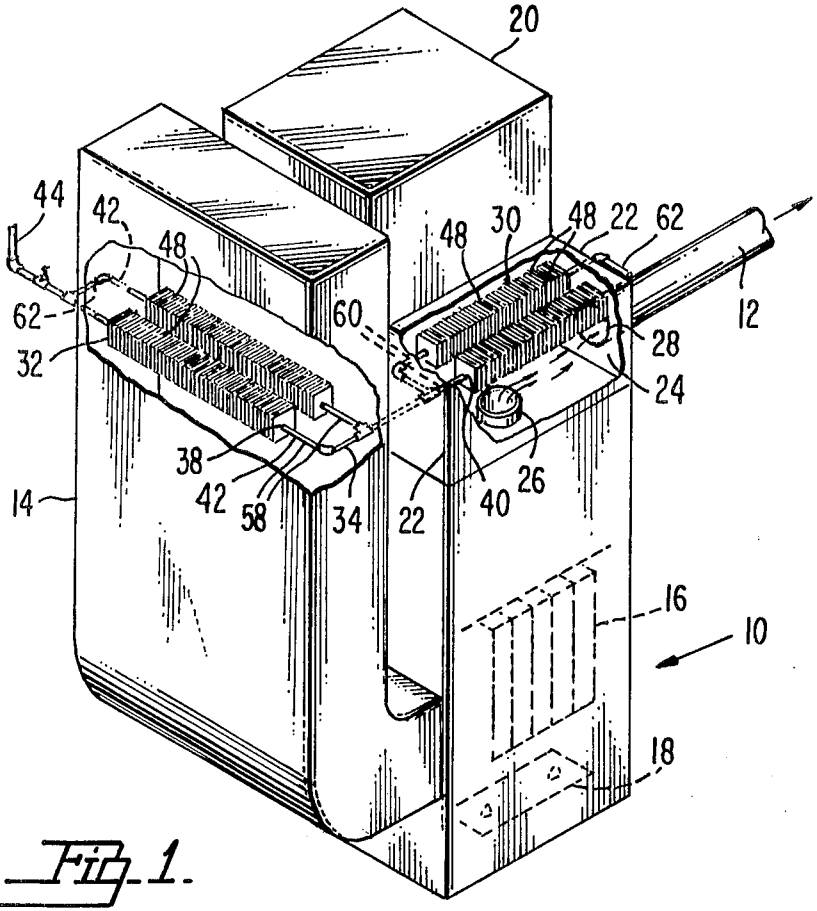
FIG. 1 is a perspective view of an embodiment of the waste heat recovery device of the present invention shown installed to a hot air gas furnace.

The return flow of fluid 36 to the boiler area 40 of conduit means 34 is facilitated by providing an elevated section 42 of the condensing area 38. Also as shown in FIG. 1 the preferable construction includes an exhaust valve 44 in the U-connection 62 adjacent the return coil means 32. The U-section 62 may be utilized to connect the opposite end of individual conduit members when individual condenser sections 58 are utilized. Fin means 56 enhances thermal flow between the surrounding environment in the cold air return 14 and the condensing area 38. Similarly fin means 56 which may preferably be formed of aluminum increases the thermal flow between the surrounding environment in the plenum chamber 24 and the boiler area 40 within the exhaust coil means 30. Also this thermal flow can be increased by the utilization of a plurality of individual coil elements 48 within either the cold air return 14 or the plenum chamber 24. Individual boiler sections 60 have been shown to be particularly useful in increasing the heat absorption from the exhausting flue gases.

Figure 3:
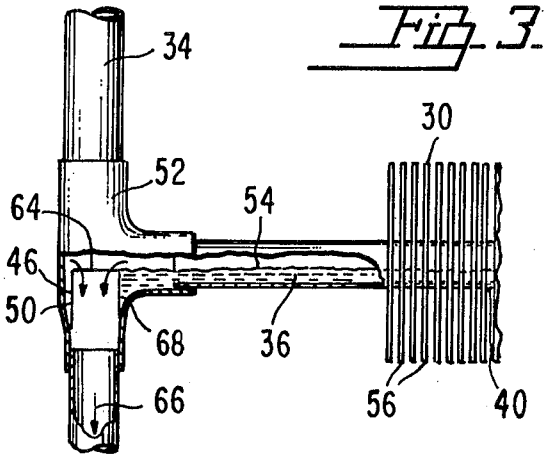
FIG. 3 is a cross-sectional exploded view of the dotted outlined FIG. 2.

Some applications wherein exhausting hot air is maintained within a vertically exhausting area have illustrated a desire for mounting the individual boiler section 60 in a vertical orientation rather than the horizontal orientation as shown in FIG. 1. In this configuration a fluid level control means 46 is desired in order to maintain a minimum level of thermal transfer fluid 36 within each individual boiler section. In order to maintain this minimum fluid level drain conduit 50 may be utilized as shown in FIGS. 2 and 3 which is usable preferably within a T-joint 52 as shown in FIG. 3 for maintaining the minimum fluid level 54. As long as the fluid within an upper condenser section 58 is below the upper edge 64 of the drain conduit 50 there will be no flow downwardly in the direction shown by arrow 66 of fluid. However once the minimum fluid level 54 reaches the upper edge 64 the fluid will start to flow downward to the next lower individual condenser section. This flow is enhanced due to the fact that the returning fluid tends to cling to the walls of the conduit and as such will tend to be gathered within the collar area 68 surrounding the drain conduit 50.

The present invention provides a device which uses basically two coils made of readily available baseboard heating element, such as copper tubing having aluminum fins which is then partially evacuated and partially filled with water. In general operation the water is boiled in the exhaust coil and condensed in the coil in the return air duct and as such a continual flow of warm air to the cold air return and a continual warming of the cold air return is achieved.

In operation the thermal transfer fluid 46 will usually be water. As such, the water will fill the boiler area 40 to a partial or intermediate level of perhaps half way. When the heating device 10 starts operation exhausting flue gases which are warm will be admitted into the plenum chamber 20 through the exhaust gas inlet 26. These hot gases will then travel past fin means 56 and heat will be absorbed therefrom to both decrease the temperature of the flue gases and to increase the temperature of the fin means 56. The cooler exhausting gases will then travel to the exhaust gas outlet 28 and pass upward through the exhaust flue 12.

Fin means 56 will concentrate the heat into the boiler areas 40 of the conduit means 34. In this manner the fluid 36 within boiler area 40 will be heated and due to the partial evacuation of the conduit means 34 the water or other fluid 36 will immediately boil and rise upwardly into the elevated section of the conduit 34 which in this configuration is the condensing area 38. These warm gases upon reaching of the condensing area 38 will heat the fin means 56 of the return coil means 32 which will in turn heat the cold air traveling through the cold air return 14 and passing thereby. In this manner the continual heating of the exhaust coil means 30 will cause a continual heating of the return coil means 32 thereby increasing the operating efficiency of the heating device 10 by warming the incoming air.

When the fluid is condensed within the condensing area 38 it will then travel downwardly by gravitational flow since the condensing area 38 is slightly elevated with respect to the remainder of the conduit 34. Gravitational flow will carry fluid 46 back to the boiler area 40 for reboiling thereof to thereby complete the cycle and hence provide a continual source of heat to the cold air return 14. To increase this rearward gravitational flow it is desirable to elevate the return coil means slightly with respect to the boiler area 40 and as such it has been shown that a one inch upward tilt of the end of the exhaust coil means 30 on the end as shown in FIG. 1 having the valve 44 will provide sufficient downward inclination to assure return of the condensed fluid to the boiler area.

In order to facilitate further thermal flow a plurality of individual coils and individual condenser sections 58 may be used. Similarly a plurality of coils and individual boiler sections 60 may be used. Under such constructions it is desirable to include the U-connection 62 at the opposite end thereof to maintain an equalization of pressure and fluid level within each condenser section 58 and boiler section 60.

If the exhaust coil means 30 is utilized in an area where the exhausting heat tends to be oriented in a vertically moving duct it is often desirable to place the individual boiler sections 60 above one another in vertical orientation rather than horizontally as shown in FIG. 1. An example of this vertical orientation is shown in FIGS. 2 and 3. With such a configuration it is particularly desirable to make sure that the level of liquid is maintained above a minimum level within each individual boiler section 60. This minimum liquid level 54 is maintained by utilizing the fluid level control means 46 which comprises a drain conduit 50 having a slightly smaller diameter than the surrounding tubing. In this manner when most conveniently placed within the T-join 52 the minimum fluid level 54 is determined as the level of the upper edge 64. As the returning liquid travels downwardly along the walls of the conduit means 34 it will be gathered within the collar area 68 surrounding the drain conduit 60 until the liquid reaches the level of the upper edge 64 of drain conduit 50. If the height of this upper edge 64 is chosen properly the desired minimum level within the boiler area 40 of this highest exhaust coil will be achieved and then the liquid can continue to flow downward in the direction of arrow 66 to the next lower exhaust coil to fill that coil to the minimum level prior to filling the next subsequent lower coil. In this manner each exhaust coil will be maintained above a minimum level prior to the flow of liquid to the next coil positioned therebelow. In this manner an unlimited number of coils may be stacked vertically in order to make full usage of gases exhausting in a vertical direction.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A waste heat recovery device for heating the air traveling through a cold air return duct to a heater device comprising:

(a) an exhaust box defining a plenum chamber therein for gathering heated exhaust gases, said exhaust box defining an exhaust gas inlet and an exhaust gas outlet to admit and expel, respectively, the heated exhaust gases with respect to said exhaust gas chamber;

(b) an exhaust coil means positioned within said plenum chamber to withdraw heat therefrom, said exhaust coil means including a plurality of individual coil elements disposed at different vertical heights with respect to one another;

(c) a return coil means positioned within a cold air return of a heating device and adapted to radiate heat to raise the temperature of the air traveling through the cold air return;

(d) a conduit means and a thermal transfer fluid which is located within said conduit means, said conduit means extending through said return coil means and said exhaust coil means to cause thermal flow therebetween by condensing and boiling of said thermal transfer fluid, said conduit means including a condensing area defined as the portion of said conduit means within said return coil means, said conduit means including a boiler area defined as the portion of said conduit means within said exhaust coil means, said condensing area being located higher than said boiler area to assure the return of condensed thermal transfer fluid after cooling thereof from said condenser area to said boiler area to allow further boiling thereof; and (e) a fluid level control means to maintain the level of thermal transfer fluid within said boiler area above a predetermined minimum level, said fluid level control means comprising a drain conduit in the conduit means extending upwardly from a lower level coil element to a higher level coil element with the upper edge thereof at the predetermined desired level of said thermal transfer fluid in the higher coil element to both maintain a minimum level of said thermal transfer fluid within the higher coil element and to provide a path for flow of said thermal transfer fluid to the lower coil element.

2. The device as defined in claim 1 wherein said conduit means includes an exhaust valve therein to control the amount of said thermal transfer fluid and the barometric pressure within said conduit means.

3. The device as defined in claim 1 wherein said return coil means includes a plurality of fin means extending outwardly from said condenser area to enhance thermal flow between said condenser area and the air traveling through the cold air return duct.

4. The device as defined in claim 1 wherein said exhaust coil means includes a plurality of fin means extending outwardly from said boiler area to enhance thermal flow between said boiler area and the air traveling through said plenum chamber.

5. The device as defined in claim 1 wherein said return coil means and said condenser area are oriented at an elevated angle with respect to said exhaust coil means to facilitate the gravitational return flow of condensed thermal transfer fluid from said condenser area to said boiler area.

6. The device as defined in claim 1 wherein said exhaust gas outlet empties into a conventional heater stack flue.

7. The device as defined in claim 1 wherein said exhaust coil means and said return coil means are made of aluminum.

8. The device as defined in claim 1 wherein said exhaust box is fixedly mounted to an existing conventional gas hot air heating furnace.

9. A waste heat recovery device for heating the air traveling through a cold air duct to a heater device comprising:

(a) an exhaust box defining a plenum chamber therein for gathering heated exhaust gases, said exhaust box defining an exhaust gas inlet and an exhaust gas outlet to admit and expel, respectively, the heated exhaust gases with respect to said exhaust gas chamber;

(b) an exhaust coil means positioned within said plenum chamber to withdraw heat therefrom, said exhaust coil means including a plurality of fin means extending outwardly from said boiler area to enhance thermal flow with the air traveling through said plenum chamber, said fin means being grouped into and defining a plurality of individual coil elements disposed at different vertical heights with respect to one another;

(c) a return coil means positioned within the cold air return of the heating device and adapted to radiate heat to raise the temperature of the air traveling through the cold air return, said return coil means including a plurality of fin means extending outwardly from said condenser area to enhance thermal flow with the air traveling through the cold air return duct;

(d) a conduit means and thermal transfer fluid which is located within said conduit means, said conduit means extending through said return coil means and said exhaust coil means to cause thermal flow therebetween by condensing and boiling of said thermal transfer fluid, said conduit means including a condensing area defined as the portion of said conduit means within said return coil means, said conduit means including a boiler area defined as the portion of said conduit means within said exhaust coil means, said condensing area being located higher than said boiling area to assure the return of condensed thermal transfer fluid from said condenser area to said boiler area to allow further boiling thereof, said conduit means further including an exhaust valve therein to control the amount of said thermal transfer fluid and the barometric pressure within said conduit means, said return coil means and said condenser area being oriented at an elevated angle with respect to said exhaust coil means to facilitate the gravitational return flow of thermal transfer fluid from said condenser area to said boiler area; and (e) a fluid level control means to maintain the level of said thermal transfer fluid within said boiler area above a predetermined minimum level, said fluid level control means comprising a draining conduit in the conduit means extending upwardly from a lower level coil element to a higher level coil element with the upper edge thereof at the predetermined desired level of said thermal transfer fluid in the coil element to both maintain a minimum level of said thermal transfer fluid within the higher coil element and to provide a path for flow of said thermal transfer fluid to the lower coil element.

* * * * *